US008187391B2

(12) United States Patent
Wood

(10) Patent No.: US 8,187,391 B2
(45) **Date of Patent: *May 29, 2012**

(54) PET WASTE AWAY DEVICE

(76) Inventor: William H. Wood, Thornton, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/975,093

(22) Filed: Dec. 21, 2010

(65) Prior Publication Data

US 2012/0001006 A1 Jan. 5, 2012

Related U.S. Application Data

(60) Division of application No. 12/408,699, filed on Mar. 21, 2009, now Pat. No. 7,909,942, which is a continuation-in-part of application No. 11/367,664, filed on Mar. 2, 2006, now abandoned.

(51) Int. Cl.
*B08B 3/10* (2006.01)

(52) U.S. Cl. ..... 134/115 R; 134/172; 134/182; 134/184; 134/198; 134/201

(58) Field of Classification Search ..... 134/115 R, 134/172, 174, 176, 179, 182, 184, 198, 201; 241/38, 168, 169.1
See application file for complete search history.

(56) References Cited

U.S. PATENT DOCUMENTS

| | | | | |
|---|---|---|---|---|
| 2,589,020 | A * | 3/1952 | North, Jr. | 239/104 |
| 2,841,923 | A * | 7/1958 | Dickison | 47/1.01 R |
| 6,260,340 | B1 * | 7/2001 | Sanner | 56/16.8 |
| 6,581,363 | B1 * | 6/2003 | Hall | 56/12.1 |
| 6,912,834 | B2 * | 7/2005 | Kasanic et al. | 56/16.8 |
| 2002/0170281 | A1 * | 11/2002 | Brown | 56/12.1 |
| 2008/0093486 | A1 * | 4/2008 | Orubor | 241/15 |

* cited by examiner

*Primary Examiner* — Joseph L Perrin
(74) *Attorney, Agent, or Firm* — Roger A. Jackson

(57) ABSTRACT

A pet waste disposal device having a motor driving a set of cutting blades inside of an open ended plenum. A water supply such as a garden hose provides water to a nozzle or jet inside of the plenum, the water washes away the waste as it is chopped by the blades. The motor may be electrical, gasoline driven, or water driven. The plenum may have a safety screen across the open end. In preferred embodiments, the device may be mounted on an elongated support with a hand grip at one end and the plenum and motor at the other end.

3 Claims, 18 Drawing Sheets

PET WASTE AWAY DEVICE

RELATED APPLICATIONS

This application is a divisional of U.S. patent application Ser. No. 12/408,699 filed on Mar. 21, 2009 now U.S. Pat. No. 7,909,942 by William H. Wood as inventor that is a continuation in part application of U.S. patent application Ser. No. 11/367,664 filed on Mar. 2, 2006 now abandoned by William H. Wood as inventor.

FIELD OF THE INVENTION

This invention relates generally to pet waste removal devices, and specifically to pet waste handlers which eliminate the waste without handling.

BACKGROUND OF THE INVENTION

Pet waste disposal is a serious problem to the average pet-owner, with the result that a great deal of ingenuity has gone into efforts to find some easy and sanitary solution to the problem. Several families of solutions are apparent after searches in the technological field.

The items in the first family of patents generally have both some sort of impact device for physically attacking the problem and water for flushing it away. However, not one of these devices appears to utilize the energy of the water flow or of an engine/motor to power the impact devices they teach. They further lack turbines, rotary chopping blades, clean and dirty compartments, etc.

U.S. Pat. No. 4,863,108 issued to MITCHELL on Sep. 5, 1989 for ANIMAL EXCREMENT DISSOLVER has a cowl and spray head, and within the cowl a group of spikes which stick straight down, bat as noted, lacks water power to the spikes, lacks rotary blades, turbine, clean compartment and so on.

U.S. Pat. No. 3,968,937 issued to inventor MILLER on Jul. 13, 1976 for DROPPING DISPOSING teaches a device with rotating blades but the blades are NOT cutting blades, rather, they are used only to scatter the water from the hose as it comes into the device. Interestingly, this device also has an exterior compartment full of water which appears to be used for weight only. This device lacks CUTTING blades, electrical, gasoline or water power, a turbine, etc. Note that the water hits the scattering blades and they spin, however, this does not appear to drive any cutting device (there is no cutting device).

U.S. Pat. No. 3,817,194 issued to SEEBALD on Jun. 18, 1974 for PORTABLE UTILITY DEVICE FOR FLUID PROCESSING OF DEMETRIUS MATERIAL teaches another manual cutting device (a grid work at the very bottom) with a sprinkler head above it. Once again, the shredding device is not driven by water, gas or electrical power, there is no power turbine, and so on.

U.S. Pat. No. 3,753,408. issued to ZIMMERMAN on Aug. 21, 1973 for HYDRO-DISINTEGRATOR teaches another such device with spikes for the impact/cutting device, and once again the device is not water powered, lacks a power turbine, motor or water, a clean compartment for a turbine, and so on.

U.S. Pat. No. 3,680,504 issued to SEEBALD on Aug. I, 1972 for MULTI-PURPOSE UTILITY DEVICE teaches a kind of cart with wheels that the user pushes along. It has sprayers on the bottom and another manual impact device with spikes, etc. This is the final patent in the first group of patents which have both sprayers AND some type of manual impact device.

The second broad group of patents is fairly numerous. These are all inventions which attempted to solve the pet waste disposal problem with water jets or sprinkler heads in some sort of device, but which did not in fact use ANY form of impact device, nor blades, spikes, etc. U.S. Pat. No. 6,077,362 to REED on Jun. 20, 2000 for PORTABLE FECES DISPERSAL DEVICE is different in teaching a device with it's own water supply and a shoulder strap as well. The limited capacity of this device reduces its utility.

U.S. Pat. No. 5,323,969 issued to MENDENHALL ET AL on Jun. 28, 1994 for PROCESS AND MECHANISM FOR REDUCTION, LIQUEFYING AND ELIMINATION OF BACK YARD WASTE at first glance contains whisks or blades of some type, projecting down into a pile of waste in the main body of the device. However, these are actually depictions of the jets of water streaming from the spray head above: there are no impact devices in this invention. In addition, it is a stationary installation into which pet waste is introduced, and thus teaches away from the present invention.

U.S. Pat. No. 4,957,131 issued to ROBINSON on Sep. 18, 1990 for ANIMAL WASTE FLUSHING ASSEMBLY at least teaches a dome which goes over the wastes, and water jets fed by something like a garden hose. However, the wastes are flushed sideways out of the enclosure and there are no chopping elements.

U.S. Pat. No. 4,744,380 issued to SHERIFF on May 17, 1988 for ANIMAL FECES DISPOSAL APPARATUS is more akin to the first group of patents in that it has both a spray head fed by a domestic water supply, and it has a certain limited ability to mash or chop up the wastes by means of a heavy mesh screen across the bottom. Whether it is in the first group or the second group, it lacks blades, a turbine, power, etc.

U.S. Pat. No. 4,485,971 to PAJEVIC on Dec. 4, 1984 for LIQUID SPRAYER is another one with a small self contained water supply and a limited effectiveness as a result. It has no impact/chopping devices.

U.S. Pat. No. 4,432,498 issued to CLEMENTS and dated Feb. 21, 1984 for an invention entitled METHOD AND APPARATUS FOR DISPOSING OF ANIMAL WASTE has had associated with it a probably erroneous set of diagrams which are for some type of gimbal device. Regardless, reading of the text of the application makes it plain that water alone is used, and is used in a water tight container. Thus this device is also is either not relevant to patentability or only dubiously relevant.

U.S. Pat. No. 4,302,040 to an inventor named LAZAR and issued Nov. 24, 1981 for the WATER JET CLEANING DEVICE is visually similar to your device in overall layout but once again, lacks water power, choppers, turbines, etc.

U.S. Pat. No. 3,770,204 to SCHUSTER on Nov. 6, 1973 for CLEANING AND REMOVAL DEVICE, the last item in the second group, is a hand held and fairly short device with an interesting valve arrangement and a rubber plunger cup. As with other patents in the second group, it lacks the distinctive features of the invention: water driven turbines powering rotary blades, etc.

Finally, U.S. Pat. No. 6,203,415 to TORRANCE-CASTANZE ET AL on Mar. 20, 2001 for DIRECT DRIVE WATER-DRIVEN ROTARY TOOL is an example of the many turbines which may be found in the patent database, but in fields unrelated to pet waste handling and disposal. The present applicant does not claim the invention of the turbine.

In general, most devices are used to handle the pet wastes, for example to place the wastes into a bag. It would be preferable to provide a device which eliminates the wastes without bagging, handling or other manipulation.

SUMMARY OF THE INVENTION

The present invention teaches that a combination of a stream of water and cutting blades in a plenum having an open end. A motor, which may be electrical, internal combustion, or a turbine driven by the water supply is used to drive the cutting blades at high speed.

Advantageously, a safety screen across the open end of the plenum is provided which may have a mesh size smaller than the diameter of a typical human finger, either a child's finger diameter or an adult finger diameter.

The water supply may be a garden hose attached to a fitting, with the garden hose or another conduit running to the plenum, or to the chamber having the motor in embodiments in which the motor is a water driven turbine.

The motor may be externally located, advantageously; at the top of the device where the user may easily access the motor the motor may also be located externally on the support shaft of the device, or externally above the wet chamber. In alternative embodiments, there may also be a chamber apart from the plenum, the motor may be in this chamber. A turbine motor may be located in the chamber, which can be open (allowing water from the turbine blades to enter the plenum, an advantage in turbine driven embodiments). The motor could be sealed (advantageous in embodiments having an electrical or gas motor), regardless of whether the motor chamber is located at the top or bottom of the device.

In use, the device is placed over an item of pet waste on the ground and the device is turned on, allowing water to enter the plenum while the blades begin chopping the pet waste into particulate matter. The combination of the chopping and water washing away the waste promptly eliminates the pet waste on typical grassy lawns: the tiny particulate matter is simply washed through the grass and into the soil.

One important factor in the device's success is the distance from the flat open bottom of the plenum to the lowermost tips of the cutting blades. On most lawns, a distance of ¾ inch (19 mm) is appropriate, though a wide range of distances may be used.

Summary in Reference to Claims

It is therefore a first aspect, advantage, objective and embodiment of the invention to provide a pet waste disposal device for use with an item of pet waste lying upon the ground, the device comprising:

an elongated support having an upper end and a lower end, the upper end dimensioned and configured for convenient use by hand;

a plenum having an interior located at the lower end of the elongated support, the plenum interior large enough to substantially cover such item of pet waste, the plenum interior having an open lower portion;

a water supply hydraulically connected to the interior of the plenum;

at least one cutting blade disposed within the interior of the plenum, the at least one cutting blade having a first end, the first end projecting within the plenum to a location a first distance X from the open lower portion;

a power supply device having an "on" state and an "off" state, the power supply inducing motion of the cutting blade when in the "on" state.

It is therefore a second aspect, advantage, objective and embodiment of the invention to provide a pet waste disposal device further comprising:

a safety screen covering the open lower portion of the plenum, the safety screen having a mesh size smaller than the diameter of a finger.

It is therefore another aspect, advantage, objective and embodiment of the invention to provide a pet waste disposal device wherein the water supply further comprises:

a connector adapted and configured to operatively hydraulically engage to the end of a garden hose.

It is therefore another aspect, advantage, objective and embodiment of the invention to provide a pet waste disposal device further comprising:

a drive shaft, the drive shaft attached to a second end of the at least one cutting blade, the drive shaft projecting into the power supply device.

It is therefore another aspect, advantage, objective and embodiment of the invention to provide a pet waste disposal device wherein the power supply device further comprises an engine.

It is therefore another aspect, advantage, objective and embodiment of the invention to provide a pet waste disposal device wherein the power supply device further comprises an electric motor.

It is therefore another aspect, advantage, objective and embodiment of the invention to provide a pet waste disposal device wherein the power supply device further comprises a water turbine, the water turbine disposed within a turbine race, wherein the water turbine is powered by water flow from the water supply.

It is therefore another aspect, advantage, objective and embodiment of the invention to provide a pet waste disposal device wherein the power supply device is located at the upper end of the elongated support, and further wherein the drive shaft is elongated to extend from the upper end of the elongated support to the lower end of the support.

It is therefore another aspect, advantage, objective and embodiment of the invention to provide a pet waste disposal device further comprising:

a chamber separated from the plenum by a wall, the power supply device disposed within the chamber, the drive shaft projecting from the second end of the cutting blade in the plenum through the wall and into the chamber.

It is therefore another aspect, advantage, objective and embodiment of the invention to provide a pet waste disposal device further comprising:

a seal around the drive shaft where it passes through the wall, whereby water from the plenum is prevented from entering the chamber and liquid in the chamber is prevented from entering the plenum.

It is therefore another aspect, advantage, objective and embodiment of the invention to provide a-pet waste disposal device further comprising: an aperture through the wall, whereby water from the chamber may enter the plenum.

It is therefore another aspect, advantage, objective and embodiment of the invention to provide a pet waste disposal device further comprising:

a second cutting blade disposed within the interior of the plenum.

It is therefore another aspect, advantage, objective and embodiment of the invention to provide a pet waste disposal device wherein the first distance "X" is in the range from 1/16 inch to 3 inches (approximately 1.5 mm to 100 mm).

It is therefore another aspect, advantage, objective and embodiment of the invention to provide a pet waste disposal device comprising:

a plenum having an interior having an opening on the bottom;

a water supply hydraulically connected to the interior of the plenum;

a nozzle within the plenum through which the water is injected into the plenum;

a plurality of cutting blades disposed within the interior of the plenum, the plurality of cutting blades projecting to a first distance of % inch from the opening;

a shaft on which the plurality of cutting blades are mounted, the shaft projecting from the plenum interior to a chamber, the shaft attached to and caused to rotate by a motor, whereby when the motor is activated, the cutting blades are caused to rotate inside the plenum.

It is therefore another aspect, advantage, objective and embodiment of the invention to provide a pet waste disposal device further comprising:

a safety screen covering the opening.

It is therefore another aspect, advantage, objective and embodiment of the invention to provide a waste disposal device for use with a standard weed trimmer, the waste disposal device comprising:

a plenum having an interior having an opening on the bottom;

a water supply hydraulically connected to the interior of the plenum;

a nozzle within the plenum through which the water is injected into the plenum;

an attachment dimensioned and configured to physically engage the standard weed trimmer.

INDEX OF REFERENCE NUMBERS

Figure 1:
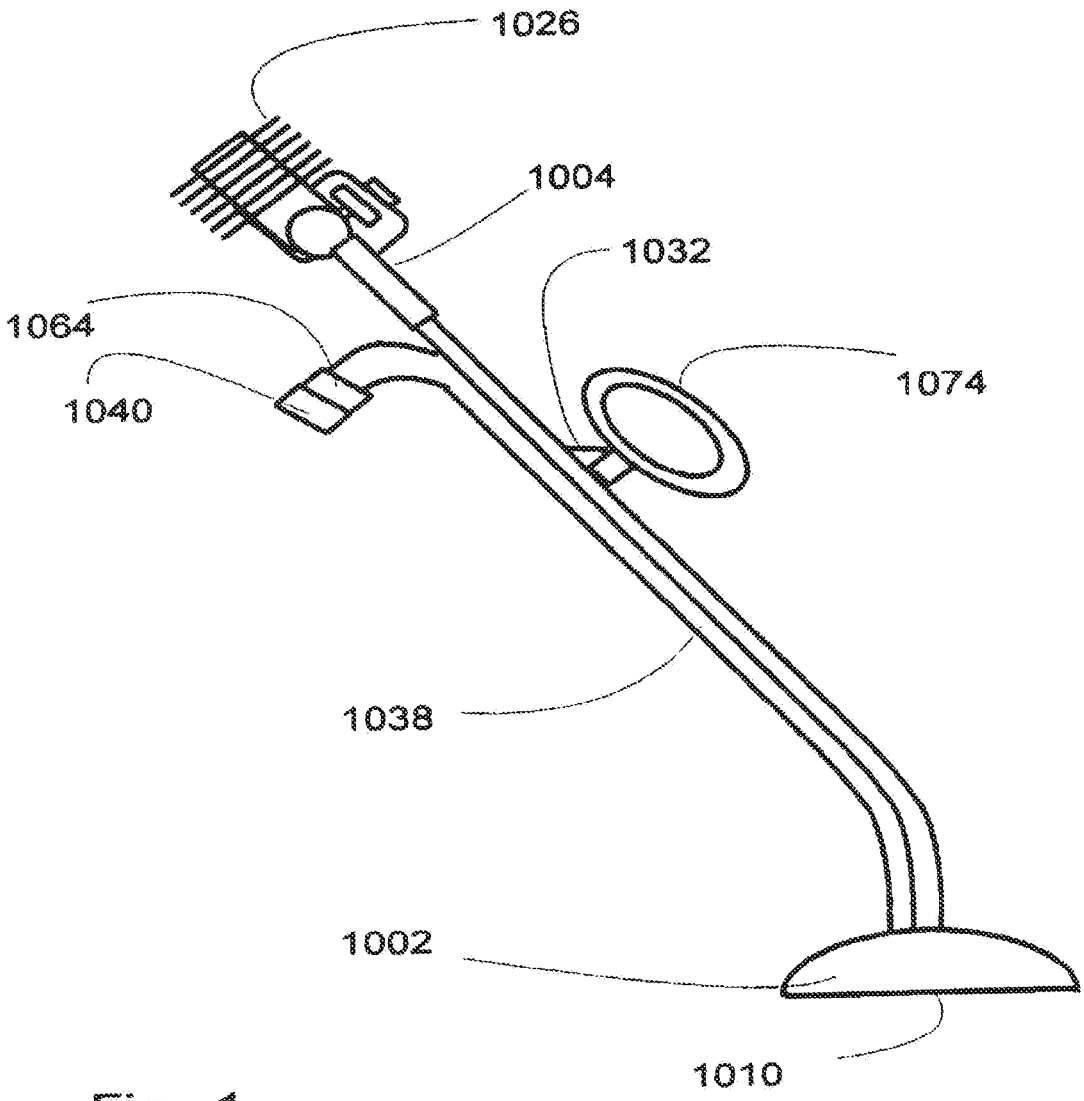
FIG. 1 is a side view of a first embodiment of the device having the engine at the upper end of the elongated support.

Pet waste disposal device 100
Plenum 102
Top of plenum 104
First plenum side 106
Second plenum side 108
Open plenum bottom 110
Wall 112
Dry chamber (dry in this embodiment) 114
Plenum interior (wet) 116
Drive shaft 118
Seal 120
Drive shaft lower end 122
Cutting blade 124
Electric motor 126
Electric motor (windings) 128
Electric motor (rotor/armature) 130
Electricity supply 132
Nozzle 134
Fitting 136
Conduit/Hose 138
Valve 140
Valve control 142
Elongated support (distal end/lower end) 144
Water 146
First distance 148
Pet waste disposal device 200
Top of plenum 204
First plenum side 206
Second plenum side 208
Open screened plenum bottom 210
Wall 212
Dry chamber (dry in this embodiment) 214
Plenum interior (wet) 216
Drive shaft 218
Seal 220
Drive shaft lower end 222
Cutting blade 224
Internal combustion engine 226
Drive train (rod/belt/shaft) 230
Engine control 232
Nozzle 234
Hose/Conduit 238
Valve 240
Valve control 242
Elongated support (distal end/lower end) 244
Water 246

Waste dispersal device 500
Body 502
Upper housing 502*a*
Lower housing 502*b*
Elongated support 506
Plenum open bottom 510
Nozzle 536
Water supply conduit 538
Control cable cover 544
Motor cooling vents 560
Control 562
Water supply coupling 564
Vertical hand grip 570
Trigger guard 572
Secondary grip 574
Safety control 576
Fastener 578
Pet waste disposal device 600
Plenum 602
Top of plenum 604
First plenum side 606
Second plenum side 608
Open plenum bottom 610
Wall 612
Upper chamber (wet in this embodiment) 614
Plenum interior 616
Aperture 618
Drive shaft lower end 622
Cutting blade 624
Valve 640
Valve control 642
Elongated support (distal end/lower end) 644
Water 646
Fitting 670
Nozzle/turbine inlet 672
Turbine 674
Turbine blade 676
Waste dispersal device 700
Upper housing 702*a*
Lower housing/plenum 702*b*
Handle 704
Elongated support 706
Electrical/water supply cover 744
Motor cooling vents 760
Control 762
Water inlet 764
Support upper/proximal end 768
Battery 790
Waste dispersal device 800
Drive shaft lower end 822
Propeller cutting blade 824
Electrical supply 832
Elongated support having electrical supply 844
Water 846
Lower housing 1002
Upper/handle end 1004
Open end 1010
Internal combustion engine 1026
Engine control 1032
Water supply conduit 1038
Water coupling 1040
Valve 1064
Handle 1074
Lower housing 1102
Upper/handle end 1104
Open end 1110
Engine control 1132
Water supply conduit 1138
Water coupling 1140
Internal combustion engine 1160
Valve 1164
Handle 1174
Lower housing 1202
Support/water supply conduit 1206/1238
Open plenum end 1210
Nozzle 1236
Valve 1264
Handle 1274
Waste dispersal device 1400
Upper housing 1402*a*
Lower housing/plenum 1402*b*
Elongated support 1406
Motor cooling devices 1460
Control 1462
Water inlet 1464
Support upper/proximal end 1468
Trigger guard 1472
Secondary grip 1474
Safety control 1476
Fastener 1478
Battery 1490
Plenum 2002
Hose/conduit 238
Fastener 2078
Attachment 2092
Weed trimmer 2094
Weed trimmer elongated support 2096
Connector 2099
Plenum 2102
Hose/conduit 2138
Fastener 2178
Gearbox 2196
Elongated support 2198
Attachment 2199
Waste disposal device for pulverizing waste matter being a $12^{th}$ embodiment 3000
Waste matter 3005
Pulverizing 3010 the waste matter 3005
Fragmenting 3011 the waste matter 3005
Chamber 3015
Base 3020
Surrounding sidewall 3025
Surrounding sidewall 3025 terminating in an opening 3030
Chamber interior 3035
Rotating element 3040
Hub 3045
Extension beam 3050
Outer peripheral portion 3055
Cutting blade 3056
Positionally nesting 3060 of the extension beam 3050 and the base 3020
Positionally nesting 3065 of the outer peripheral portion 3055 and the surrounding sidewall 3025
Means 3070 for rotationally driving the rotating element 3040
Rotational speed 3075 of at least ten-thousand revolutions per minute
Orifice 3080
Longitudinal axis 3085 of orifice 3080
Tangential position 3090 of orifice 3080 longitudinal axis 3085 therethrough the surrounding sidewall 3025
Water exit velocity 3095 from orifice 3080
Selected fluid dispenser 3100
Longitudinal axis 3105 of selected fluid dispenser 3100

Tangential position 3110 of selected fluid dispenser 3100 longitudinal axis 3105 therethrough the surrounding sidewall 3025

High speed electric motor 3115 for means 3070

High speed internal combustion engine 3120 for means 3070

DETAILED DESCRIPTION

Figure 2:
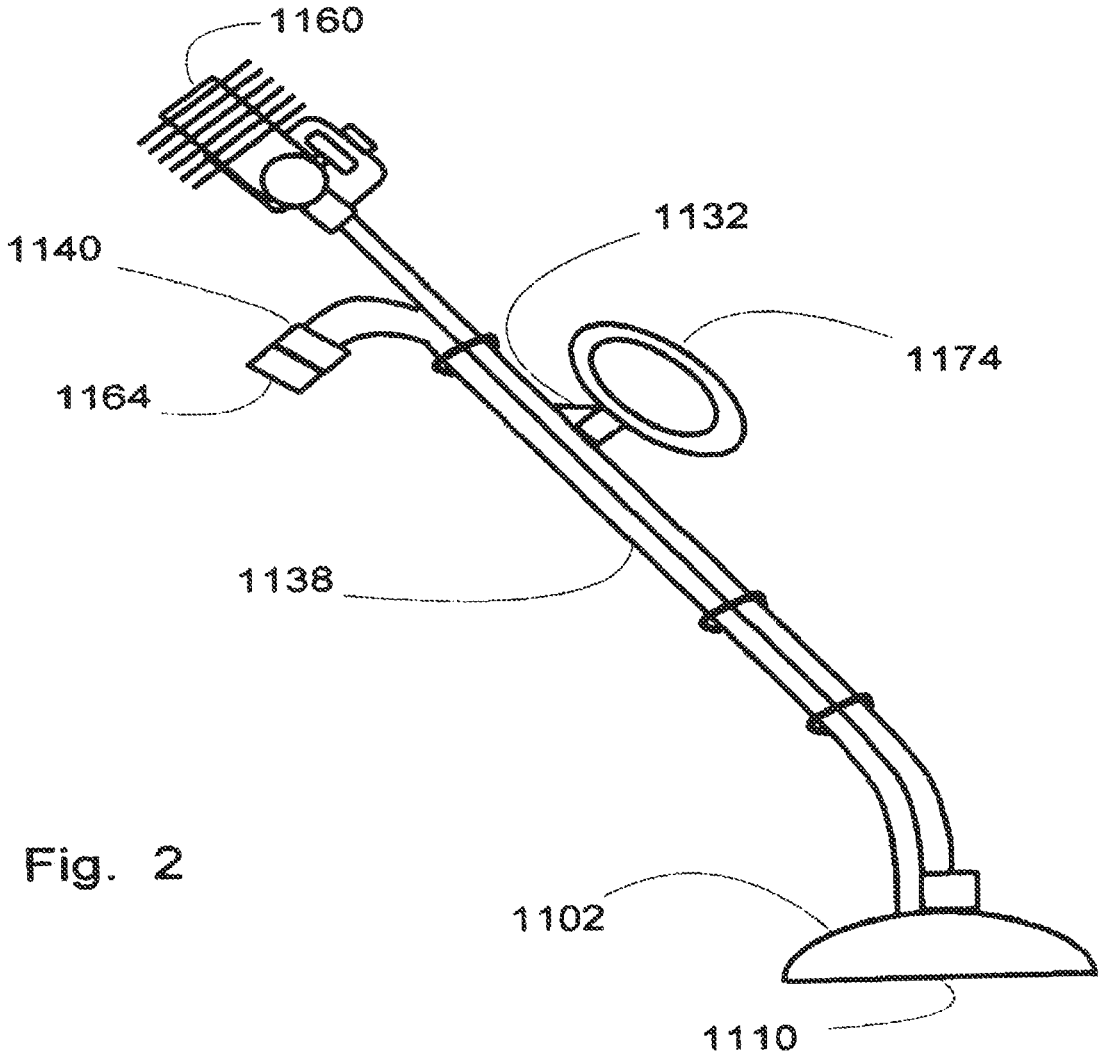
FIG. 2 is a side view of a second embodiment of the device having the engine located at the upper end of the elongated support.

FIG. 1 is a side view of a first embodiment of the device having the engine at the upper end of the elongated support. FIG. 2 is a side view of a second embodiment of the device having the engine located at the upper end of the elongated support, having a different support and housing for the elongated drive shaft.

Lower housings 1002, 1102 are connected by an elongated support to upper/handle end 1004. The elongated support may double as a torque tube or drive shaft housing, with flexible or rigid housing within it. If the shaft is rigid, it may be necessary to provide a gear to redirect the rotation from the shaft direction to the direction of the shaft of the blades within the housing.

Open ends 1010, 1110 of lower housings 1002, 1102 allow the device to be placed over a pile of pet wastes and operated, as will be discussed further below.

Internal combustion engine 1026, 1160 induces motion of the cutting blades (seen in later diagrams) when in the "on" state by supplying power thereto via a drive shaft.

Engine controls 1032, 1132 allows the user to turn the engine on or off, or may control the throttle, be a choke, and so on.

Water supply conduits 1038, 1138 may be pipes or hoses or rigid or flexible design allowing water to reach the lower end of the device and a nozzle inside the plenum of the lower housings 1002, 1102. Water couplings 1040, 1140 allows connection to a water source such as a garden hose or the like. Valves 1064, 1164 has open and closed positions and thus allows the water flow to be turned on or off.

Handles 1074, 1174 may be positioned relatively near the center of gravity of the device in heavier versions such as those having gasoline engines, or may be positioned nearer the top as in other embodiments.

Figure 11:
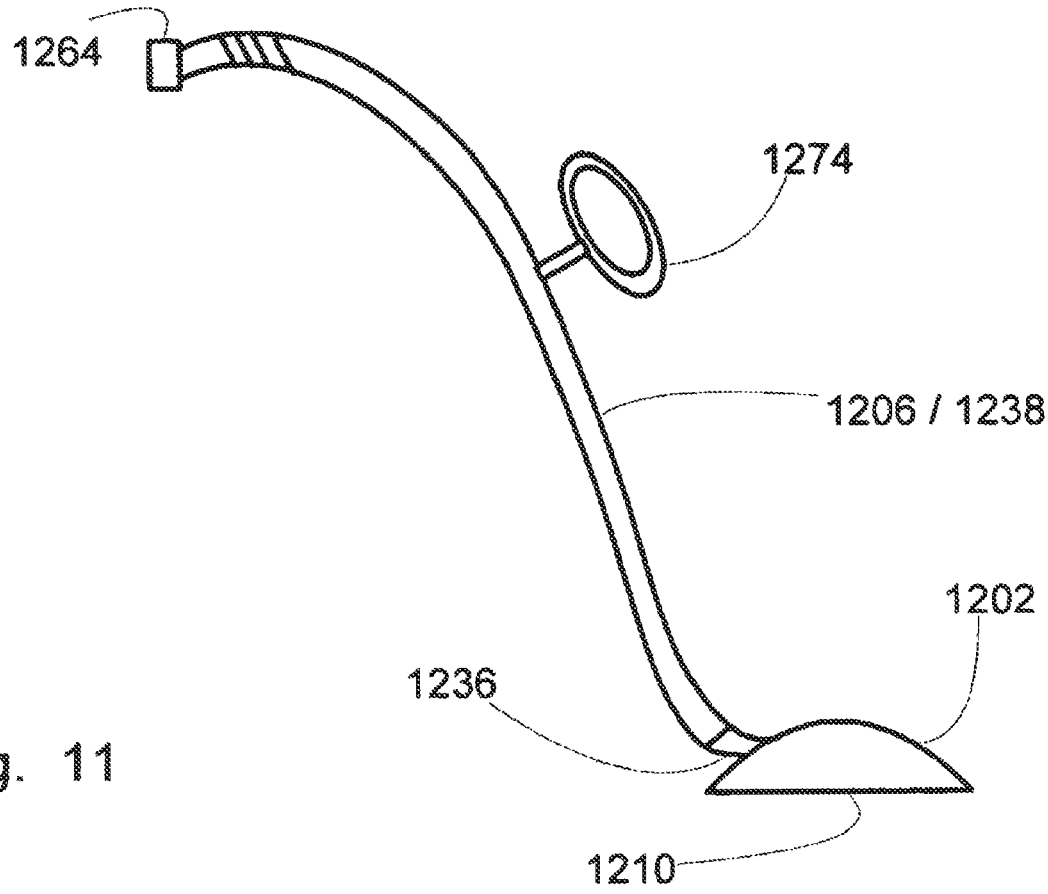
FIG. 11 is a side view of a water turbine powered version of the device.

FIG. 11 is a side view of a water turbine powered version of the device. Lower housing 1202 has within it the propellers or cutting blades which act inside open plenum end 1210 to remove pet wastes. Support/water supply conduit 1206/1238 may carry water down to the nozzle 1236 internally, thus making for lighter construction.

Valve 1264 allows control of water flow in first and second positions which may be open, closed, or additional positions which are partially open.

Handle 1274 may be located at a convenient distance above the lower end for a user of typical height, or may be movable between different locations, for example, for users of different heights.

Figure 9:
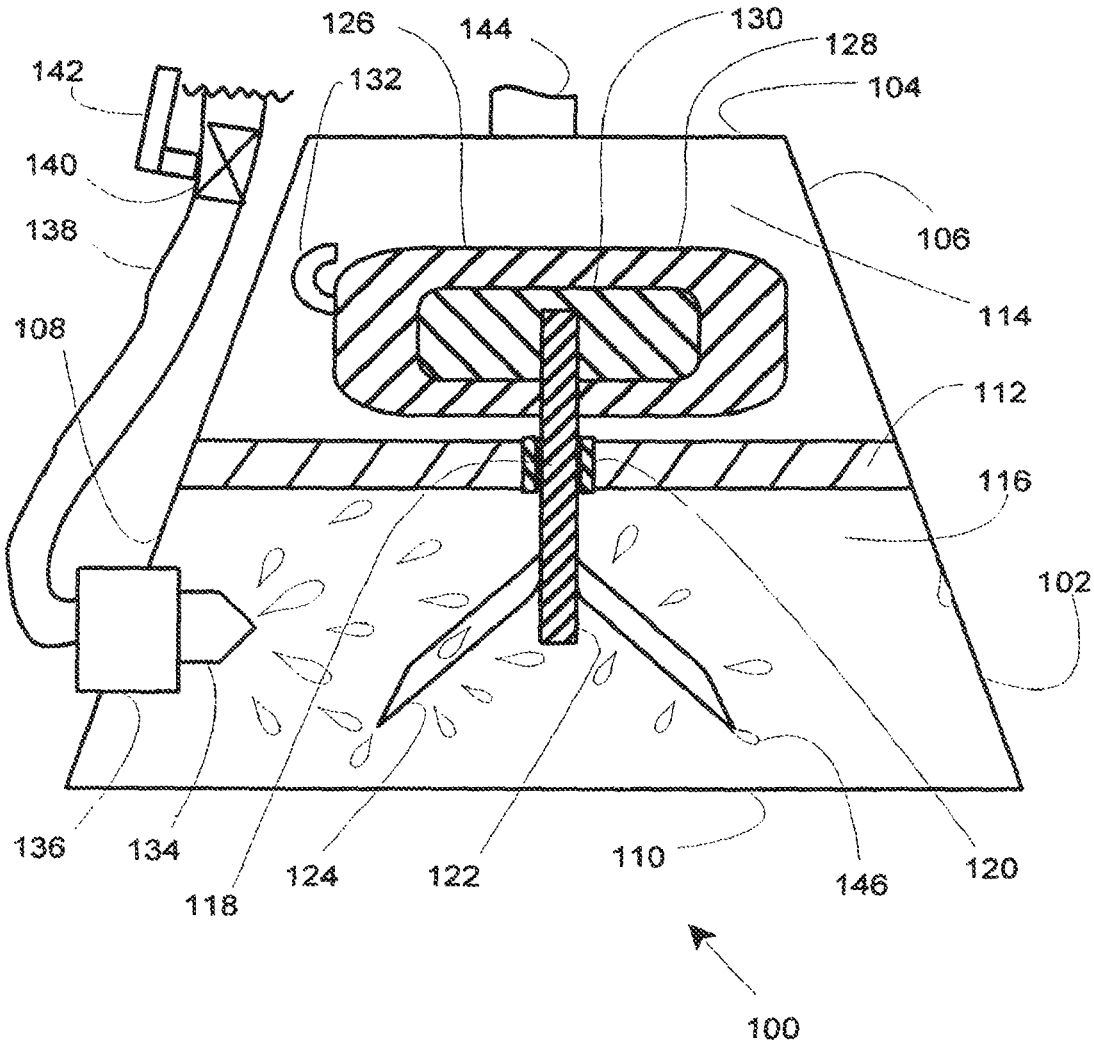
FIG. 9 is a partial cross-sectional block diagram of a ninth embodiment of the device, an alternative not the preferred embodiment, having a sealed chamber above the plenum.

FIG. 9 is a partial cross-sectional block diagram of a first embodiment of the device. Pet waste disposal device 100 has plenum 102. A top of plenum 104 may have a power source located therein. First plenum side 106 and second plenum side 108 may be of a wide variety of sizes and shapes: the plenum may be cylindrical, a frustum, irregular, bowl shaped, irregular, a prism or other shapes.

Open plenum bottom 110 is the operative end of the device. Wall 112 divides the overall housing into a dry chamber 114 (dry in this embodiment but wet in others, and no upper plenum exists at all in certain embodiments with the engine located at the upper end of the support 144) from the plenum interior 116, which is wet from the spray or jets of water therein. Drive shaft 118 passes through wall 112 to provide motive power to the cutting blades 124. Seal 120 prevents water from plenum interior 116 entering the upper chamber 114.

Drive shaft lower end 122 has cutting blade 124. In the preferred embodiments, several cutting blades 124 are used, and they may be of any natural blade or cutting device configuration. Cutting blades 124 may advantageously be quite stiff in order to chop through harder pet wastes, or they may be relatively flexible so as to minimize damage to ground cover flora. Cutting blades 124 may thus be metal, plastic, polymer line, and the like: in the best mode now contemplated, metal is the preferred embodiment.

Electric motor 126 has electric motor windings 128 and electric motor rotor/armature 130. When electricity supply 132 is activated, the electric motor 126 will cause drive shaft 118 to move (rotation in this embodiment but other motions are possible) and blades 124 move, chopping, mashing or otherwise disintegrating pet wastes within plenum 116. Electric motor 126 thus has two states: "on" and "off".

Nozzle 134 provides jets or sprays of water 146. Nozzle 134 is fed from and in operative hydraulic connection with fitting 136, which may be a standard hose connector or a nozzle housing, seal or the like. Conduit 138 carries water from the ultimate water supply (which may be a garden hose or the like) via valve 140. Valve 140 also has two or more states, "on" and "off", and partially "on" states, valve control 142 is used to control the valve and switch it between the two states.

In use, when the blades 124 chop up pet wastes, water 146 will act to wash the resulting particulate waste straight down through the grass of a typical lawn, and further will dissolve such particulate matter and carry it into the soil under the pet wastes.

Elongated support 144 (only the lower end distal from the user and proximate the pet wastes is shown in FIG. 1) may be a pole, a body, a casing, or the like. In the presently preferred embodiments having the engine at the upper end of the elongated support 144, an elongated drive shaft of sufficient length to reach from the engine to the plenum may run down the length of support 144, preferably internally. Such a drive shaft may be either flexible or rigid. In other embodiments, elongated support 144 may also function as a shroud for electrical connections to an electrical motor (for example support 144 may carry the cable or wire of electrical supply 132 within itself), for control cables for a gasoline engine, may carry the water supply internally and so on. It also obviously supports the entire housing area shown in block diagram FIG. 1, so that the user may stand while using the device yet support the housing at ground level.

Figure 3:
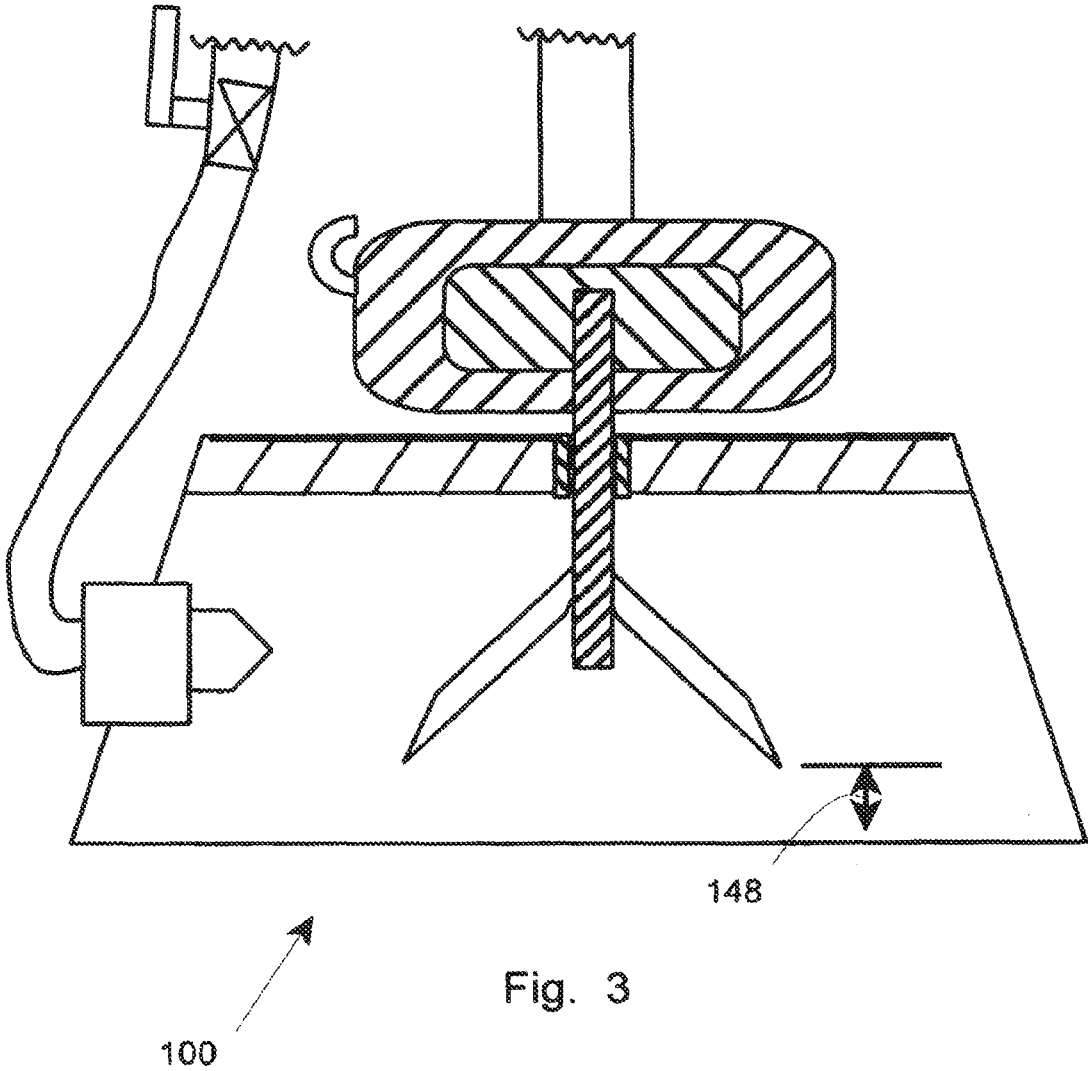
FIG. 3 is a partial cross-sectional block diagram of a third embodiment of the device, showing a preferred ground clearance for the device and an externally mounted motor at the lower end.

FIG. 3 is a partial cross-sectional block diagram of a third embodiment of the device, showing a preferred ground clearance for the device. First distance 148 is of importance in the present invention. In particular, the invention may be optimized for use on different types of surfaces by adjustment of first distance 148. First distance 148 may be adjusted by the user, or may be set at the time of manufacture of the device. Testing on typical suburban lawns reveals that first distance 148 may advantageously be approximately 2.5 inches (approx. 63 mm). For lower lawns, this may be reduced, and for bare ground, the distance can be as small as 1/16 of an inch or less (1.5 mm or less). For different ground cover (longer grasses, clover, succulent ground covers, etc) it may be advantageous to increase first distance 148 to as much as several inches. (4 inches or more, 100 mm or more).

Figure 10:
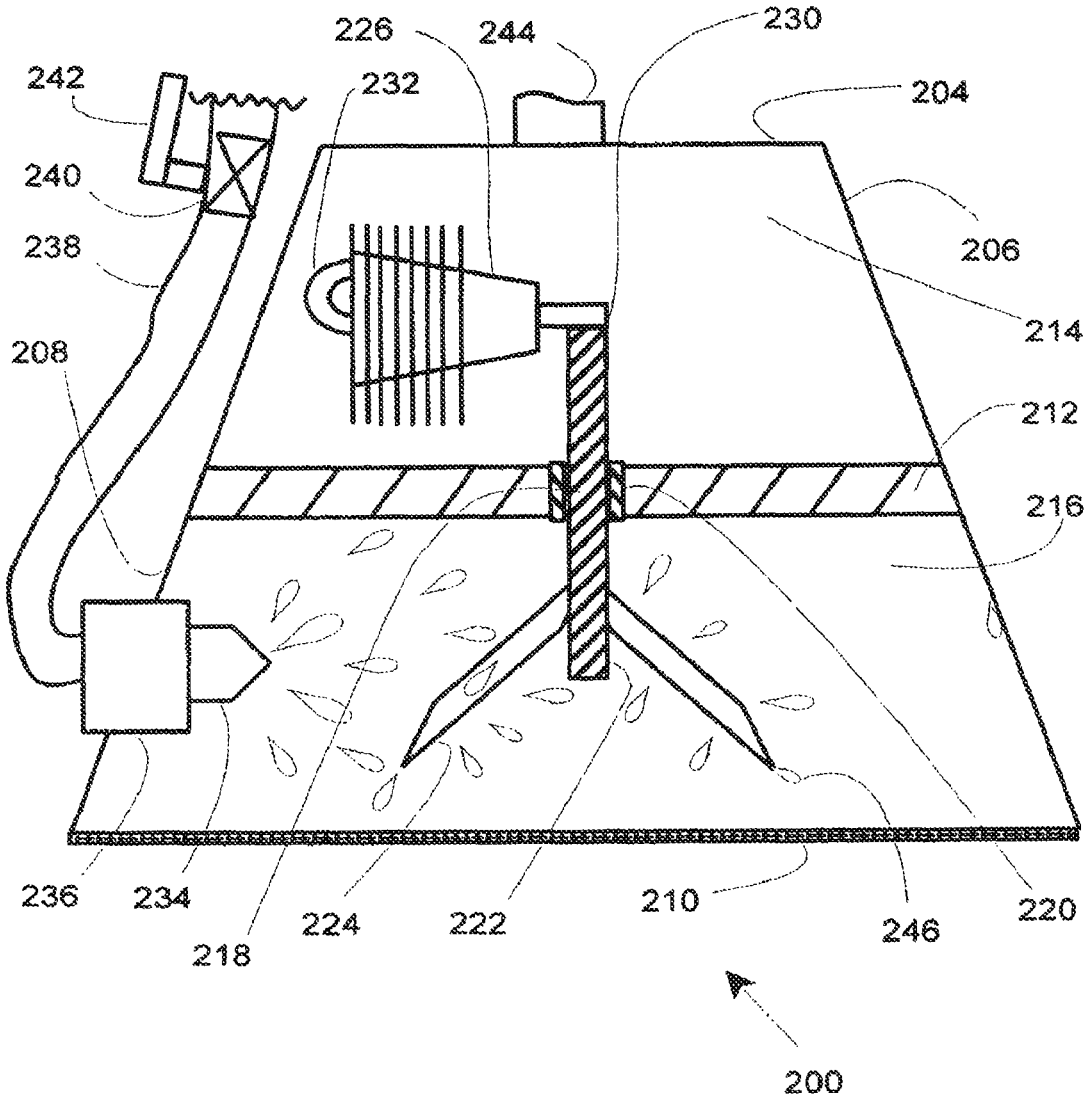
FIG. 10 is a partial cross-sectional block diagram of a second embodiment of the device, having a screen across the bottom and powered by an internal combustion engine.

FIG. 10 is a partial cross-sectional block diagram of a second embodiment of the device, having a safety screen across the bottom and powered by a gasoline engine. Pet waste disposal device 200 has a plenum top 204 and sides 206, 208, similar to the first embodiment. However, screen plenum bottom 210 is different. In addition to serving safety purposes, screen 210 may also provide an initial round of disintegration of pet wastes.

Wall 212 separates dry chamber 214 from wet plenum 216, drive shaft 218 penetrates via seal 220 to drive shaft lower end 222 having blade or other disintegration means 224. In this embodiment the power supply device is internal combustion engine 226 having a drive train (such as a piston rod, drive belt or drive shaft, a flexible shaft or straight shaft, rotating cable, etc) 230 and engine control 232 (a control cable or the like). Internal combustion engine 226 may be a single, double or four stroke engine, may be powered by gasoline or other petroleum products, may have one cylinder or more and may have other standard features known in "gasoline" engines.

Nozzle 234, fitting 236, conduit 238, valve 240 and valve control 242 may be as previously described in relation to the first embodiment. Nozzle 234 may put out a steady stream of water 246, a number of jets, a spray, a mist and other types of water flows. Substantial water flow, however, is preferred, in order to speed the disintegration, dissolving and dispersal into the soil of pet wastes.

Elongated support has a distal end/lower end 244 which may be used to support the housing and associated equipment.

Figure 4:
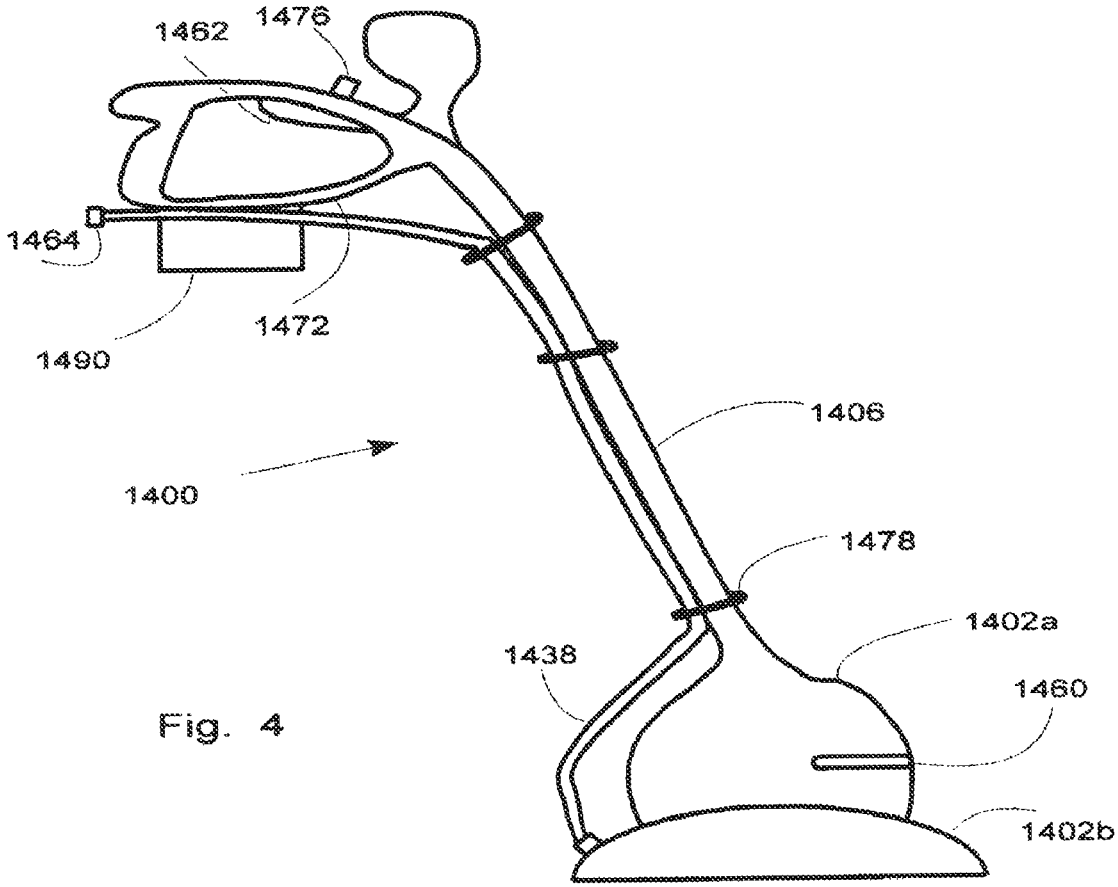
FIG. 4 is a side view of a fourth embodiment of the invention, a battery electricity powered version having a sealed motor at the lower end.

FIG. 4 is a side view of a fourth embodiment of the invention, a light and handy electrically powered battery version.

Waste dispersal device 1400 may be approximately the size and shape of an electric weed trimmer. Upper housing 1402*a* houses an electric motor (not shown in FIG. 4, see FIG. 1). Lower housing/plenum 1402*b* houses the cutting and washing equipment such as nozzles and disintegration means (also not shown in FIG. 4, see FIG. 1).

The handle may be one end of elongated support 1406 if the entire body is manufactured of a small number of plastic parts. Electrical/water supply covering may be separate from elongated support 1406 but in the presently preferred embodiment and best mode now contemplated, the elongated support 1406 and the shroud may be combined by running electrical conduits and/or water conduits and/or control cables down the interior of the elongated support 1406.

Motor cooling devices 1460 may provide air circulation from the exterior to the electric motor within the housing. Such vents may be arranged so as to prevent water or foreign matter from reaching the compartment having the motor or the motor itself. Cooling fins, or cooling vents may be, used as motor cooling devices 1460, and may be supplemented with cooling fans, radiators or the like. Control 1462 may be a button, trigger, lever, bail, etc, arranged in a convenient location for the user, normally on the handle. A water inlet 1464 may be comfortably disposed on the handle as well. However, this aspect is not presently preferred (for example compared to the embodiment of FIG. 7) as it suffers from the potential problem of having the water and battery connections in close proximity. In other embodiments, electrical connections may be dispensed with, while in others, the electrical connections to the battery 1490 may be on the handle while the water connection is located at the distal end of the apparatus, for example on housing 1402*b*.

The support upper/proximal end may in preferred embodiments be the handle. In other embodiments, the handle may be attached to the support upper end. In either case, the support upper end should be long enough to allow the lower end to be placed on the ground while the upper end remains comfortably in hand for a standing user.

Figure 5:
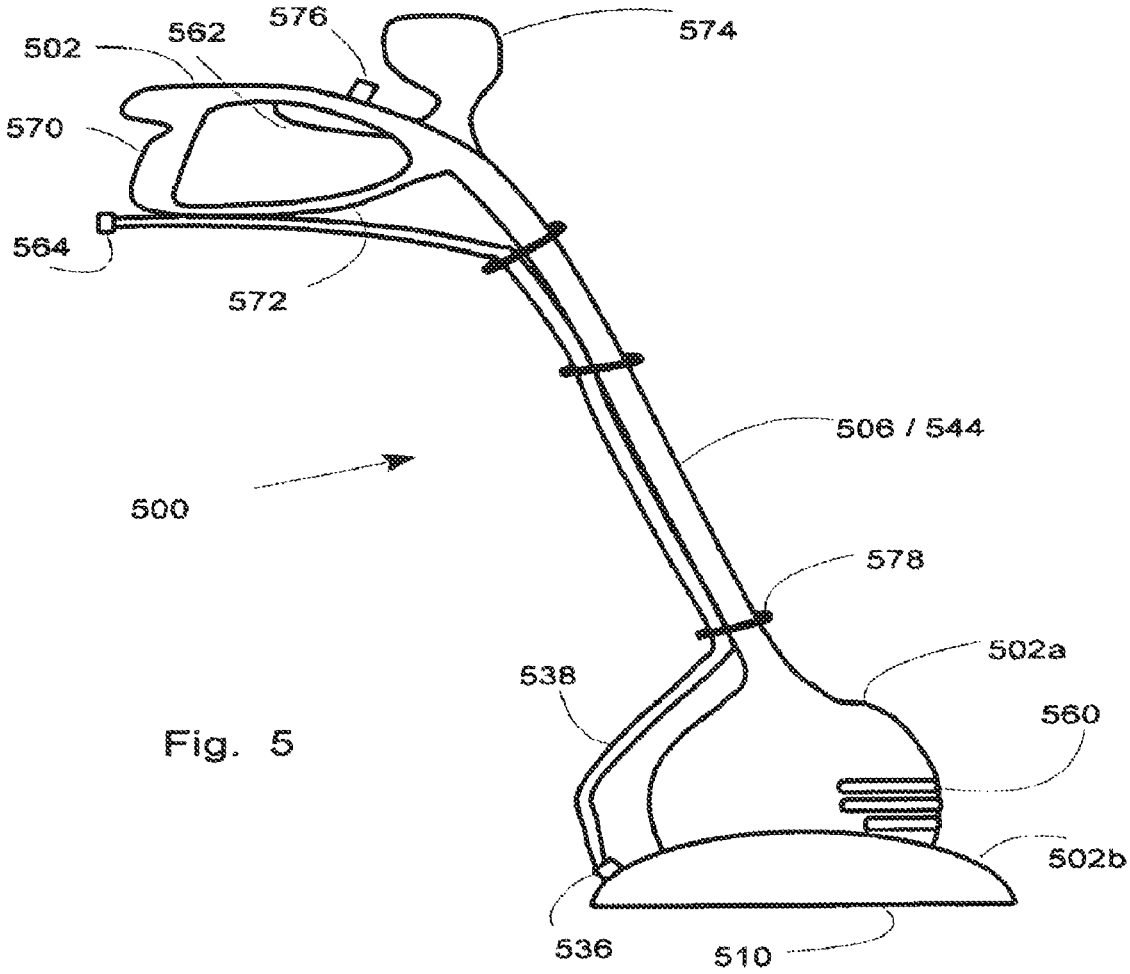
FIG. 5 is a side view of a fifth embodiment of the invention, a heavy duty version powered by an internal combustion engine at the bottom end of the unit elongated support.

FIG. 5 is a side view of a fifth embodiment of the invention, a heavy duty version powered by an internal combustion engine. Waste dispersal device 500 has body 502 having upper housing 502*a*, lower housing 502*b*, elongated support 506 and plenum open bottom 510.

The body of the device may advantageously be molded plastic, however, in embodiments, the body may be other materials. In particular, testing has shown that making lower housing 502*b* (the plenum) of a stronger material such has stainless steel provides benefits in terms of user confidence and sturdiness.

Nozzle 536 is fed from water supply conduit 538 in turn fed by a garden hose attached to water supply coupling 564, a standard hose connector. Fastener 578 may be used to secure the conduit 538 (which may be a hose, tube, pipe or the like) to control cable cover 544 (itself the elongated support 506). Thus in this embodiment, the water supply passes outside of the elongated support 506 which still functions as a shroud for the control cables inside.

Motor cooling vents 560 in housing 502*a* may allow cooling air to circulate to the engine. Control 562 may be provided on the handle 502. The configuration of handle 502 may vary from other embodiments: a vertical hand grip 570 may be provided, as well as a trigger guard 572, a secondary grip 574 and a safety control 576. Safety control 576 may simply be a bail or button which must be continuously depress or raised in order to keep the engine running.

Figure 6:
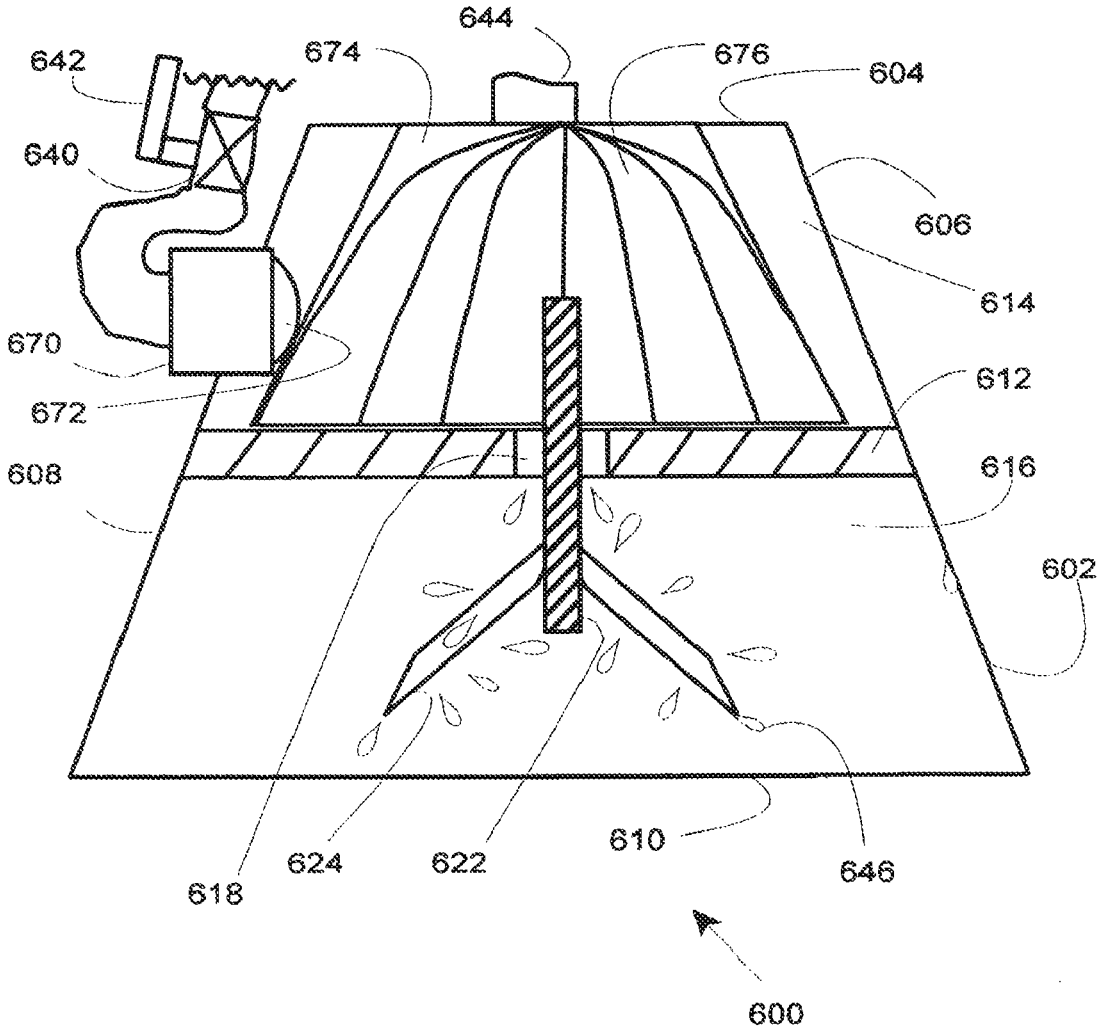
FIG. 6 is a partial cross-sectional block diagram of a sixth embodiment of the device, powered by a water turbine at the bottom end of the device.

FIG. 6 is a partial cross-sectional block diagram of a sixth embodiment of the device, powered by a water turbine. Pet waste disposal device 600 has plenum 602 having top 604 and sides 606, 608, as well as open plenum bottom 610 and cutting blade 624.

In this embodiment wall 612 does not form a seal between wet upper chamber (wet in this 5 embodiment) 614 and plenum interior 616. Aperture 618 not only allows drive shaft lower end 622 to protrude from the upper chamber 614 into the plenum 616, it also allows water 646 to pass from the upper chamber 614 to the plenum 616.

This embodiment is turbine driven, with the water pressure from the water supply used both the wash away and dissolve particulate wastes and also to operate the cutting/disintegration 10 means.

Valve 640 has both "on" and "off" states controlled by valve control 642. In the off state no water flow is allowed while in the on state, water flows. Thus in this embodiment, valve control 642 controls both water flow and also operation of the blades 624. While valve control 642 is depicted near housing/plenum top 604, it may be located on the elongated support 644 near the distal end (shown), medially or at the user proximate upper end (not shown).

Fitting 670 supplies nozzle/turbine inlet 672 which acts to inject water into turbine 674. Water acting on turbine blade 676 operates the turbine, forcing it to rotate and thus rotating the drive shaft and finally the mechanical waste disintegration means (in this embodiment, blades 624).

Figure 7:
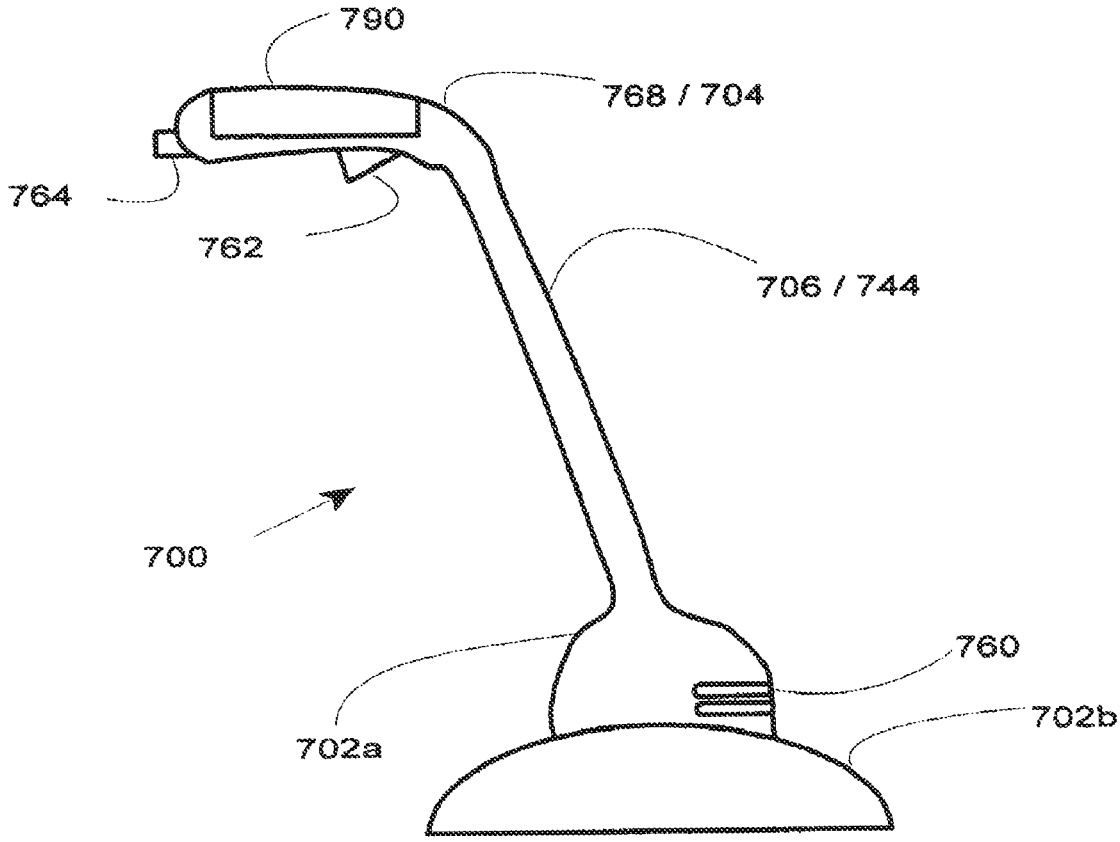
FIG. 7 is a side view of a seventh embodiment of the device, electrically powered with a battery as the source of electrical current.

FIG. 7 is a side view of a seventh embodiment of the device, electrically powered with a battery as the source of electrical current. Waste dispersal device 700 is similar to the embodiment of FIG. 4, with an upper housing 702*a* having the electrical motor therein, a lower housing/plenum 702*b* having the cutting blades therein, handle 704 for the user connected to the housings by elongated support 706 having therein electrical and water supply devices such as wires, cables, conduits, hoses, pipes and the like, electrical/water supply cover 744 (which may be the support 706 or may be separate therefrom), motor cooling vents 760 and at least one control 762.

In this embodiment, water inlet 764 is not located close to an electrical connection (i.e. is not close to a plug and extension cord socket) because support upper/proximal end 768 (which may be handle 704) has therein battery 790. This is deemed a safer design and thus preferable for that reason over the embodiment of FIG. 4: battery power tends to be lower voltage than line current, the connections may be distal from one another, and so on. The battery 790 may be disposable, rechargeable, and the like, and it may be located as shown or in the housing or the like.

Figure 8:
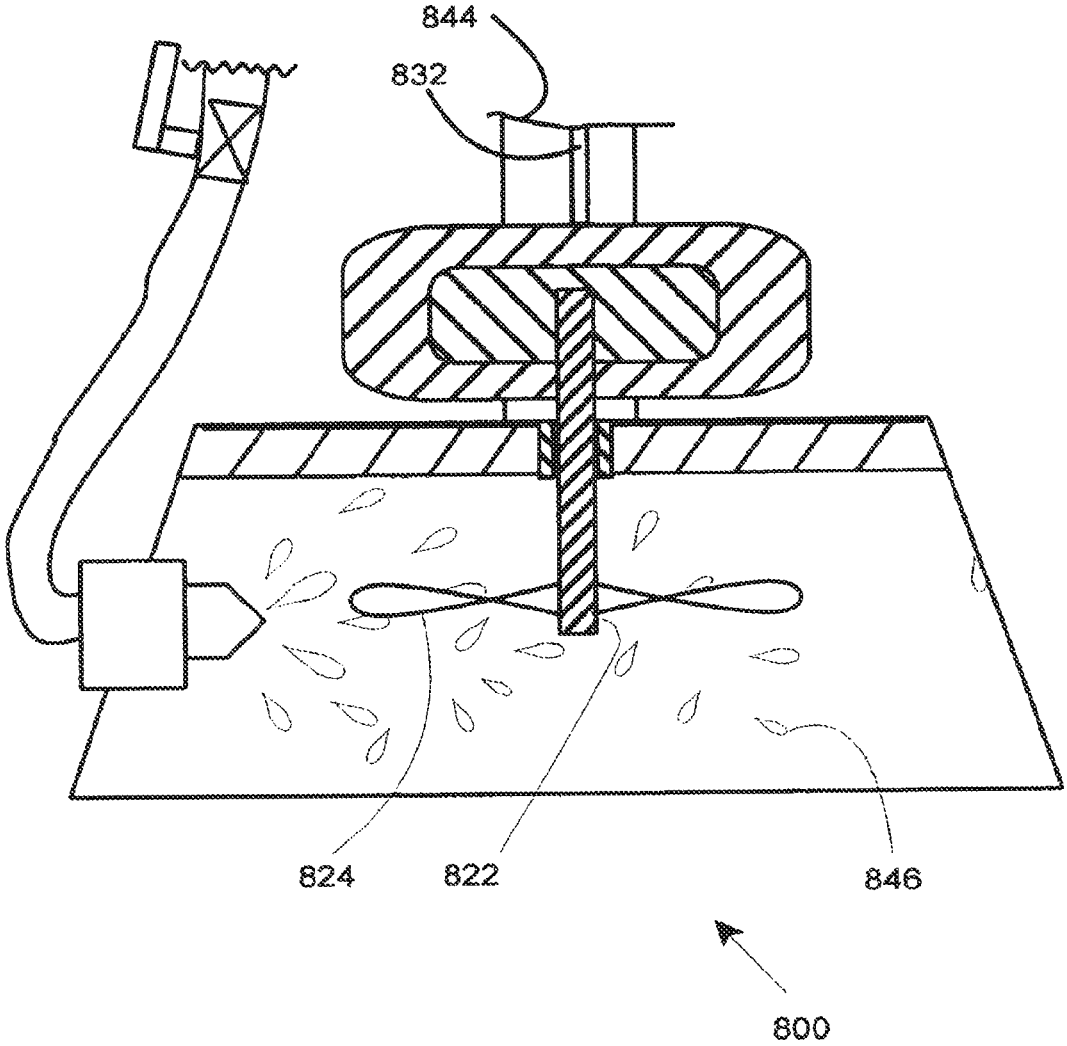
FIG. 8 is a partial cross-sectional block diagram of an eighth embodiment of the device using a propeller for cutting of wastes and having an external motor at the lower end.

FIG. 8 is a partial cross-sectional block diagram of an eighth embodiment of the device using a propeller for cutting of wastes. Waste dispersal device 800 has drive shaft lower end 822 having propeller shaped cutting blade 824. This design is an efficient chopping mechanism and may provide better dispersion of the wastes after the chopping.

Electrical supply 832 may, as discussed, pass within elongated support having electrical supply 844, as may the water supply from water connector 764.

Water 846 may be impelled in different directions and manners by the shape of the cutting blades 824.

Figure 12:
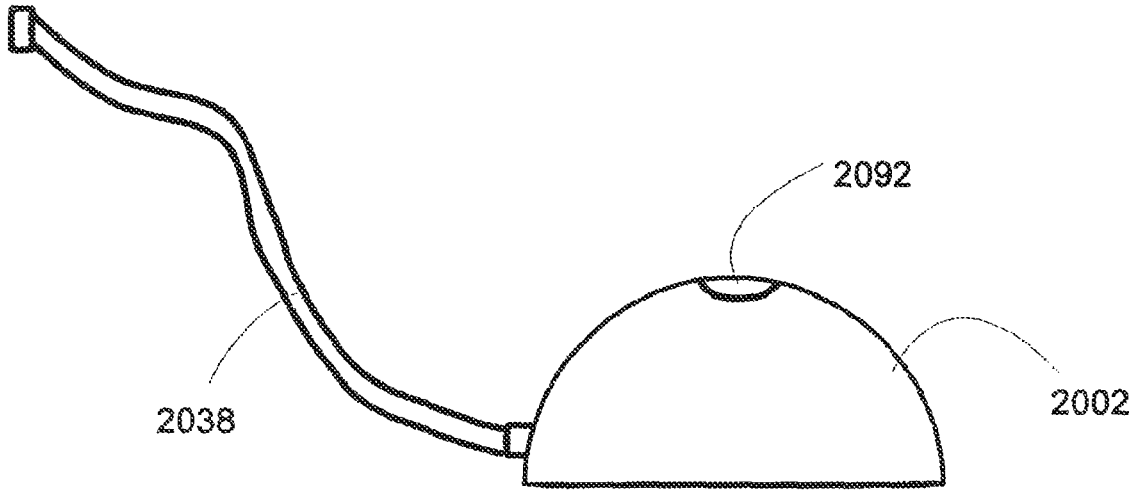
FIG. 12 is a side view of a tenth embodiment of the device useable with a conventional weed trimmer.

FIG. 12 is a side view of a tenth embodiment of the device useable with a conventional weed trimmer. Plenum 2002 and conduit 2038 are much as previously described in reference to other embodiments, however, attachment 2092 is dimensioned and configured to allow a conventional weed trimmer device to be attached thereto in physical engagement therewith and with the cutting blades of the weed trimmer passing through the aperture of attachment 2092 and into the interior of plenum 2002. In use, the operator will turn on the weed trimmer in its normal cutting mode and also will supply water to conduit 2038 and thus to the interior of plenum 2002, where it will be blown and sprayed by the cutting devices at the bottom of the weed trimmer: nylon line, cutting blades or the like. Water may be supplied by means of a garden hose or the like.

Figure 13:
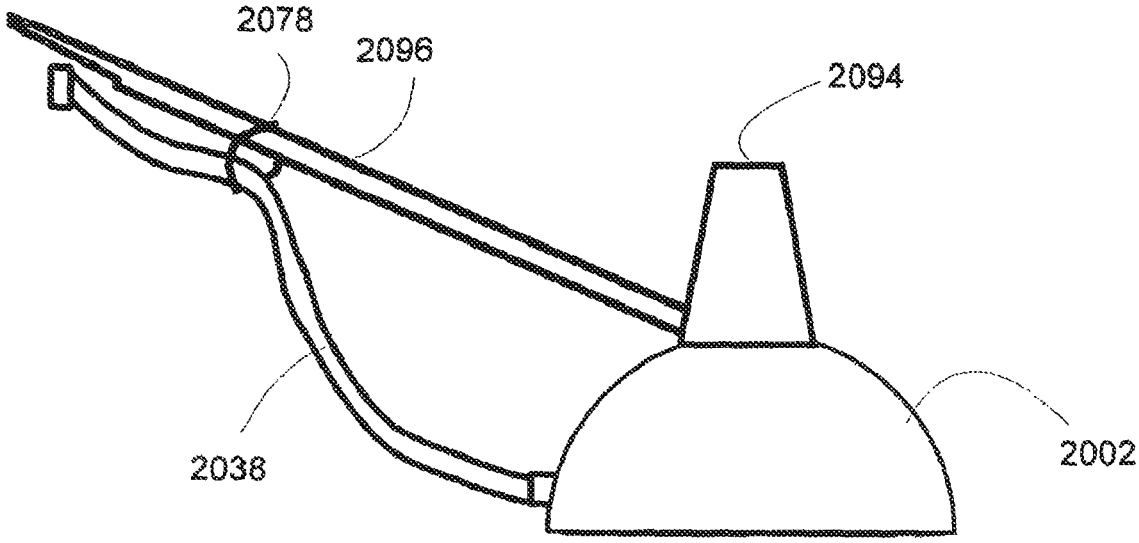
FIG. 13 is a side view of the tenth embodiment of the device in use with a conventional weed trimmer.

FIG. 13 is a side view of the tenth embodiment of the device in use with a conventional weed trimmer.

Fastener 2078 allows the conduit 2038 (a hose, such as a garden hose) to be attached to the weed trimmer elongated support 2096 while attachment 2092 is secured to weed trimmer 2094 in the position of use. (The elongated support 2096 is not shown in its entirety.) It is anticipated that the device will be used with a standard gas powered unit only for safety reasons, preferably a straight shaft type. However, variations may be made in embodiments, or such variations as are safe for the operator. In particular, it is anticipated that it may not be safe to require an operator to use a conventional 120 VAC electric trimmer with sharp cutting blade and with an electrical extension cord, while maneuvering a garden hose as well and standing on wet ground.

Figure 14:
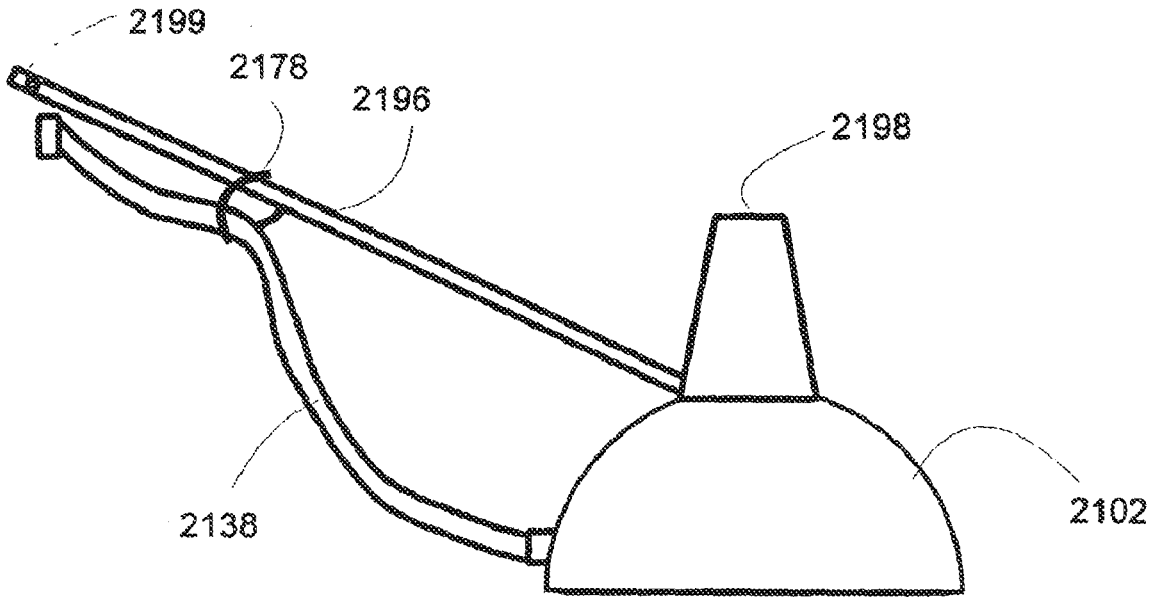
FIG. 14 is a side view of the eleventh embodiment of the device, a standard accessory for gas weed trimmers.

FIG. 14 is a side view of the eleventh embodiment of the device, a standard accessory for gas weed trimmers. The gas trimmer is not shown. The device has hose/conduit 2138 as well as plenum 2102. This device has gearbox 2198 which transfers power from the drive shaft within elongated support 2196 to cutting blades (not shown) within the plenum. Thus this embodiment does not rely upon the cutting head of the weed trimmer, as it has been found during testing that certain types of weed trimmer cutting heads (nylon line, for example) simply do not cut well for pet wastes. Attachment/standardized connector 2199 is used to attach the device to a standard gasoline trimmer, while fastener 2178 may attach it to a elongated support.

This embodiment may have a standardized connector 2199 and a standard shaft, gearbox, etc, similar to known gasoline trimmer attachments and accessories like blowers, thus rendering the embodiment commercially similar to products already on the market.

In embodiments, the user may have a choice of cutting blades which can be replaced depending upon personal preference, grass conditions, waste conditions or the like. In embodiments, the user may have removable safety screen across the bottom which can be replaced by a choice of screens depending again upon personal preference, grass conditions, waste conditions or the like.

Figure 15:
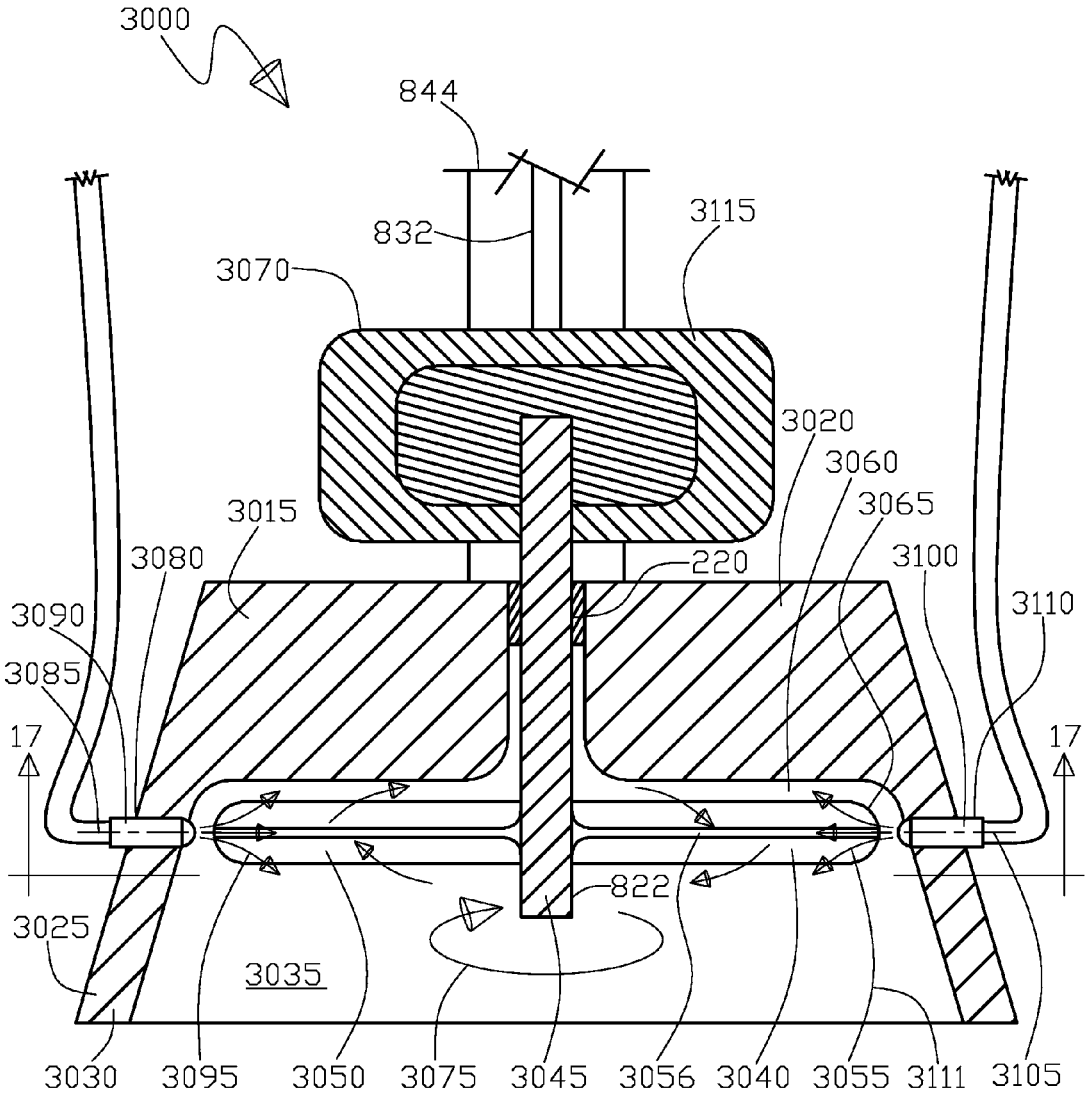
FIG. 15 is a cross sectional side elevation view of the twelfth embodiment of the device with the external electric motor showing a close fitting plenum to the impeller with the tangential water injection nozzle and the tangential chemical injection nozzle.
Figure 16:
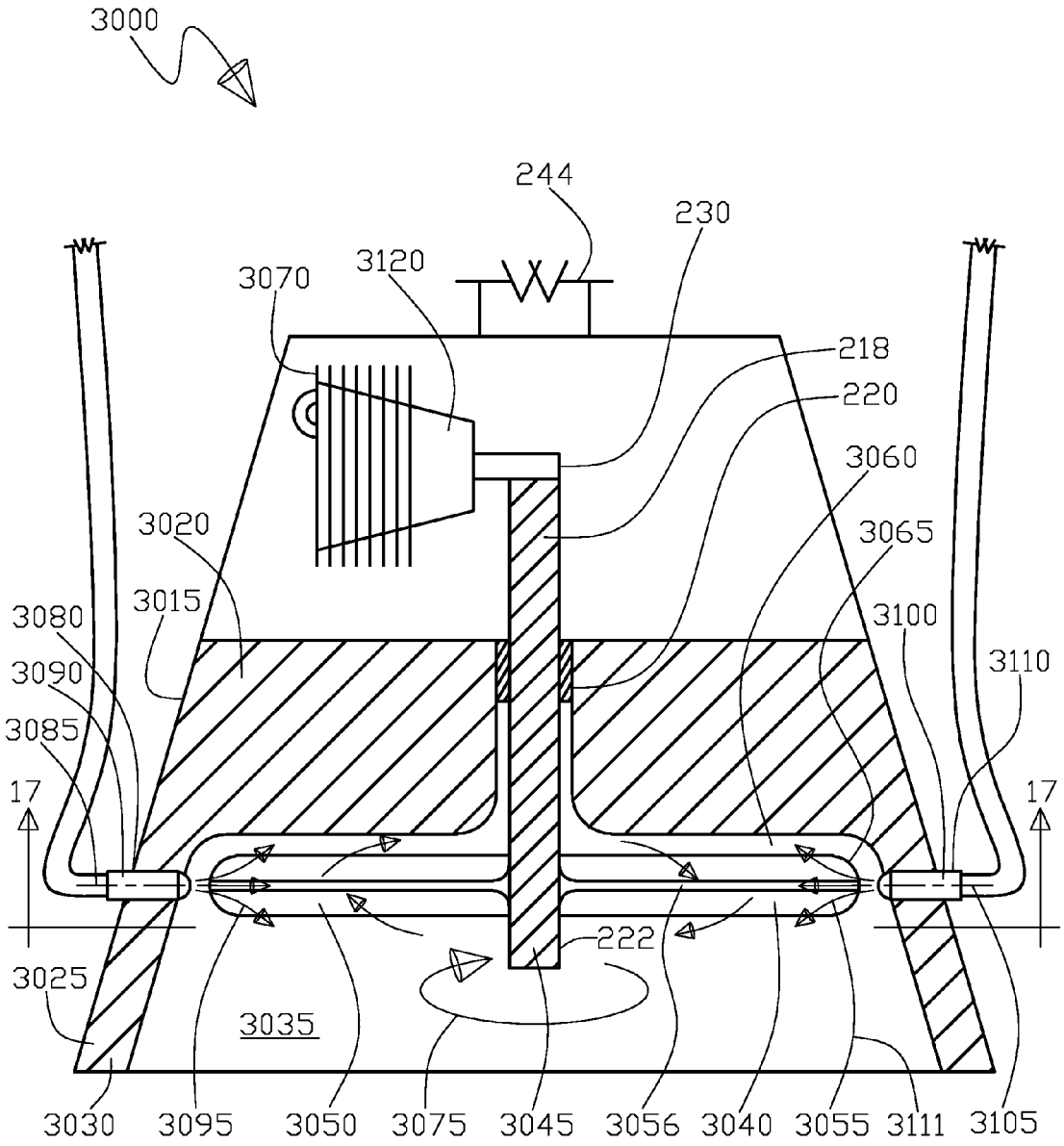
FIG. 16 is a cross sectional side elevation view of the thirteenth embodiment of the device with the external internal combustion engine showing a close fitting plenum to the impeller with the tangential water injection nozzle and the tangential chemical injection nozzle.
Figure 17:
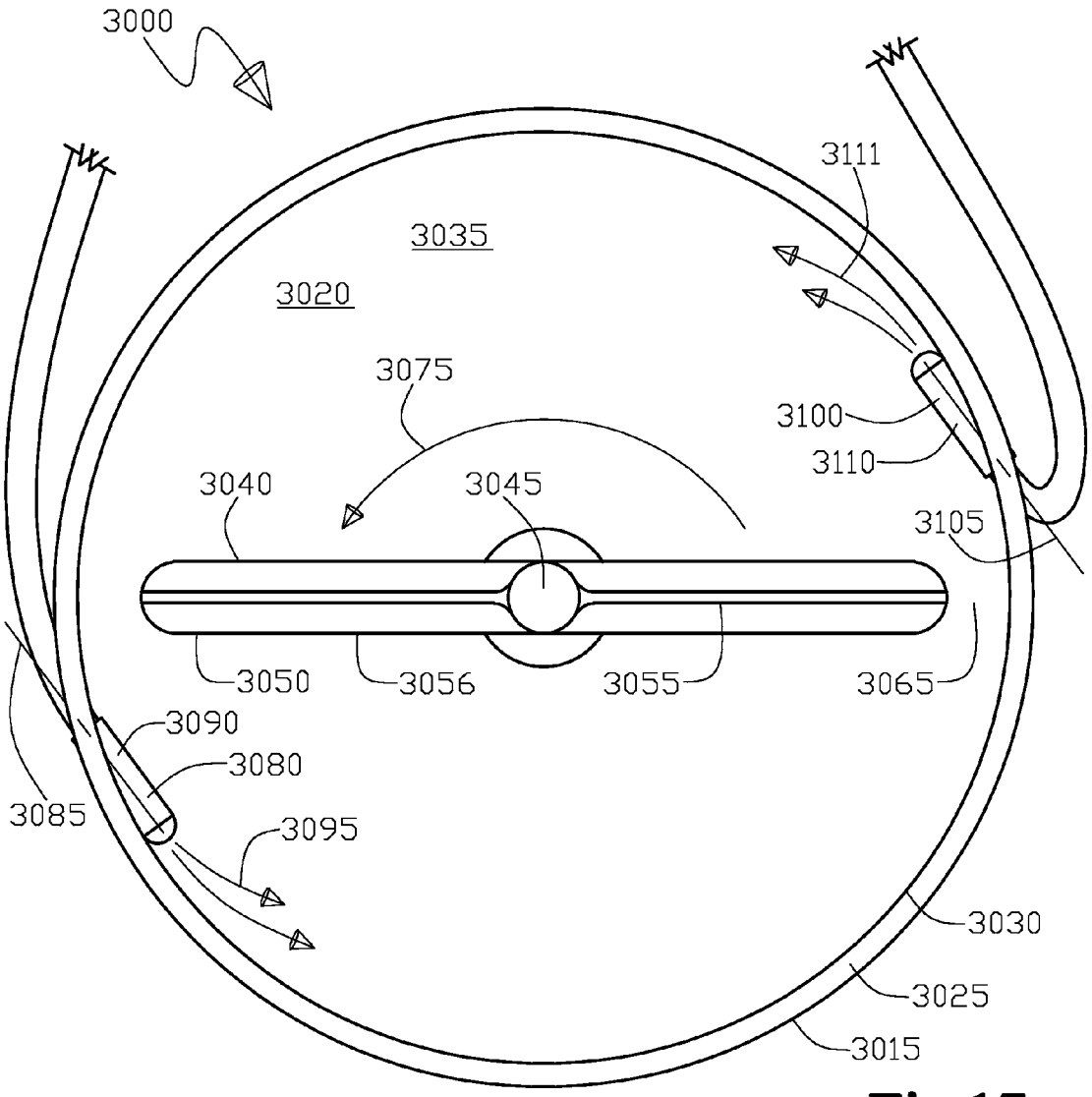
FIG. 17 is view 17-17 from both FIGS. 15 and 16 showing the grass or surface side of the close fitting plenum specifically indicating the tangential water injection nozzle and the tangential chemical injection nozzle positional orientation.
Figure 18:
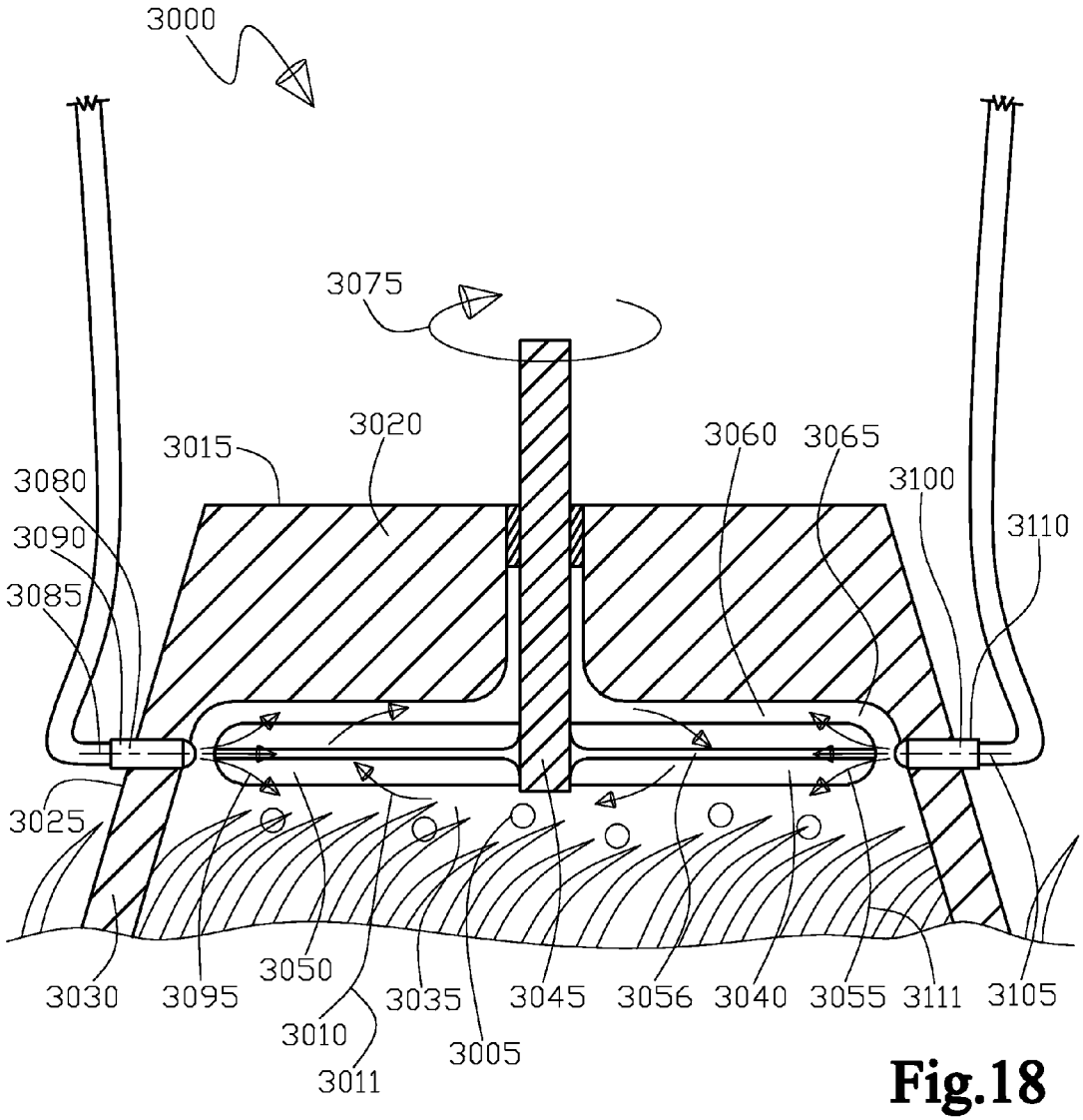
FIG. 18 is the in use side elevation view of the twelfth and thirteenth embodiments of the device as shown in FIGS. 15, 16, and 17.

In focusing upon FIGS. 15, 16, 17, and 18 for the twelfth embodiment 3000 of the waste disposal device 3000 for pulverizing 3010 and fragmenting 3011 the waste matter 3005, the waste disposal device 3000 includes a chamber 3015 having a base 3020 and a surrounding sidewall 3025 extending from the base 3020, with the surrounding sidewall 3025 terminating in an opening 3030, wherein the base 3020 and the surrounding sidewall 3025 define a chamber interior 3035, a best shown in FIGS. 15 and 16 in cross section and FIG. 17 from a view looking at the chamber 3015 from the opening 3030. Further included in the waste disposal device 3000 is a rotating element 3040 including a hub 3045 having an extension beam 3050 terminating in an outer peripheral portion 3055 such that the extension beam 3050 is sized and configured to positionally nest 3060 adjacent to the base 3020, as best shown in FIGS. 15 and 16, in addition to the outer peripheral portion 3055 being sized and configured to positionally nest 3065 adjacent to the surrounding sidewall 3025 as best again shown in FIGS. 15 and 16. Note that the adjacent portions of the beam 3050 to the base 3020 and the outer peripheral portion 3055 to sidewall 3025 have a preferred gap spacing of about 2% of the outer peripheral portion 3055 perimeter, in order to better maintain the rotating element 3040 induced pulverizing 3010 turbulence in the injected 3095 water in the interior 3035.

Continuing for the waste disposal device 3000, also included is a means 3070 for rotationally driving the rotating element 3040 hub 3045 to a rotational speed 3075 of at least ten-thousand revolutions per minute for the purpose of adding velocity energy to a water injection stream. Thus in addition for inclusion in the waste disposal device 3000 is an orifice 3080 having a longitudinal axis 3085, wherein the longitudinal axis 3085 is tangentially positioned 3090 therethrough the surrounding sidewall 3025 relative to the outer peripheral portion 3055, as best shown in FIGS. 15, 16, and 17. Wherein, operationally facilitating tangentially positioned 3090 water injection velocity 3095 therethrough the orifice 3080 from a water source wherein the rotating element 3040 at least doubles the water velocity 3095 exiting from the orifice 3080 forming a turbulent waste matter 3005 pulverizing 3010 environment within the chamber interior 3035 as best shown in the use FIG. 18.

Optionally, on the waste disposal device 3000 for the rotating element 3040 the extension beam 3050 can further include a cutting blade 3056, that is best shown in FIGS. 15, 16, and 17, wherein the cutting blade 3056 is operational to assist in fragmenting 3011 the waste matter 3005 through a high speed chopping action due to the ten-thousand plus revolutions per minutes speed 3075 of the rotating element 3040, note this blade 3056 can take on a number of configurations, being blunt or sharp with a long or short protrusion extending from the beam 3050.

Alternatively, another option for the waste disposal device 3000 could further comprise a selected fluid dispenser 3100 that is positioned 3110 therethrough the surrounding sidewall 3025 such that a longitudinal axis 3105 is oriented tangentially 3110 to the outer peripheral portion 3055, as best shown in FIGS. 15, 16, and 17. Operationally the selected fluid dispenser 3100 dispenses a selected fluid 3111 to be injected tangentially to the outer peripheral portion 3055 from a selected fluid source. The selected fluid could be an anti-bacterial agent, deodorant, colorant, or the like.

For the waste disposal device 3000 means 3070 as previously described to achieve the preferred high rotational speed of ten-thousand revolutions per minute 3075 for rotationally driving the rotating element 3040 is preferably a high speed electric motor 3115 or a high speed internal combustion engine 3120, or any other suitable equivalent that can achieve the desired high rotational speed of ten-thousand revolutions per minute 3075.

For the waste disposal device 3000, as shown in FIGS. 15, 16, 17, and 18, to operate effectively is pulverizing 3010 and fragmenting 3011 the waste matter 3005, a high level of energy is required in the form of velocity energy supplied primarily by the rotating element 3040 in the form of a high rotational speed, being at least ten-thousand revolutions per minute (RPM) thus requiring a special purpose electric motor of internal combustion engine that are typically found of weed trimmers of which utilize also the high rotational speed typically operating around 12,000 RPM giving the required weed cutting string a peripheral velocity that is required to cut thick stemmed weeds. Thus for the waste disposal device 3000 pulverizing 3010 and fragmenting 3011 of the waste matter 3005 the high rotational speed being at least 10,000 RPM 3075 creates a highly turbulent environment within the chamber interior 3035 by combining the high tip speed or outer peripheral portion 3055 of the rotating element 3040 operating in the range of about 250 feet per second, wherein the velocity of about 250 feet per second is imparted upon the water exiting velocity 3095 from the orifice 3080, with the water exit velocity in the range of about 80 feet per second, assuming approximately 100 feet of water head available, equaling about 50 pounds per square inch (PSI) pressure that is in a typical municipal water supply system. Thus the outer peripheral portion 3055 of the rotating element 3040 operating in the range of about 250 feet per second will greatly increase the velocity of the water exiting 3095 the orifice 3080 entering into the chamber 3015 interior 3035 at about 80 feet per second putting the mixture of the water and waste matter 3005 in a turbulent and pulverizing 3010 mode to fragment 3011 the waste matter 3005 in an acceptable amount of time being about 10-20 seconds. As it was found with numerous tests, with only using a municipal water system to pulverize the waste matter, say for instance with a water turbine driven rotating blade, there just was not enough velocity energy available with about a 100 feet of water head available in the form of potential energy from the municipal water system (such that no additional high speed electric motor or internal combustion engine was used) to pulverize the waste matter well in an acceptable amount of time. Thus in other words using only the municipal water system alone cannot provide adequate pulverizing velocity energy for the waste disposal device to function properly, i.e. non complete waste matter pulverizing and an excessive amount of time required being multiple minutes.

The disclosure is provided to allow practice of the invention by those skilled in the art without undue experimentation, including the best mode presently contemplated and the presently preferred embodiment. Nothing in this disclosure is to be taken to limit the scope of the invention, which is susceptible to numerous alterations, equivalents and substitutions without departing from the scope and spirit of the invention. The scope of the invention is to be understood from the appended claims.

The invention claimed is:

1. A waste disposal device for pulverizing waste matter, comprising:

(a) a chamber having a base and a surrounding sidewall extending from said base, said sidewall terminating in an opening, wherein said base and said surrounding sidewall define a chamber interior;

(b) a rotating element including a hub having an extension beam terminating in an outer peripheral portion such that said extension beam is sized and configured to positionally nest adjacent to said base and said outer peripheral portion is sized and configured to positionally nest adjacent to said surrounding sidewall;

(c) a high speed internal combustion engine for rotationally driving said rotating element hub to a rotational speed of at least ten-thousand revolutions per minute; and (d) an orifice having a longitudinal axis, wherein said longitudinal axis is tangentially positioned therethrough said surrounding sidewall relative to said outer peripheral portion, operationally facilitating tangentially positioned water injection therethrough said orifice from a water source wherein said rotating element at least doubles the water velocity exiting from said orifice forming a turbulent waste matter pulverizing environment within said chamber interior.

2. A waste disposal device according to claim 1 wherein said extension beam further includes a cutting blade that is operational to assist in fragmenting the waste matter.

3. A waste disposal device according to claim 1 further comprising a selected fluid dispenser that is positioned therethrough said surrounding sidewall such that operationally the selected fluid is injected tangentially to said outer periphery from a selected fluid source.

* * * * *